United States Patent [19]

Komaki

[11] 4,236,375

[45] Dec. 2, 1980

[54] ELECTRONIC WATCH

[75] Inventor: Shojiro Komaki, Tokyo, Japan

[73] Assignee: Kabushiki Kaisha Daini Seikosha, Tokyo, Japan

[21] Appl. No.: 834,004

[22] Filed: Sep. 16, 1977

[30] Foreign Application Priority Data

Sep. 20, 1976 [JP] Japan ..... 51-112760

[51] Int. Cl.[3] ..... G04C 21/12

[52] U.S. Cl. ..... 368/73; 368/79; 368/98; 368/109; 368/117; 368/230

[58] Field of Search ..... 58/23 R, 38 R, 38 A, 58/39, 39.5, 57.5, 126 C, 152 B

[56] References Cited

U.S. PATENT DOCUMENTS

| | | | |
|---|---|---|---|
| 3,210,924 | 10/1965 | Dodd | 58/38 |
| 3,938,317 | 2/1976 | Spano | 58/126 C |
| 4,074,516 | 2/1978 | Kondo | 58/38 R |
| 4,078,376 | 3/1978 | Freeman | 58/23 R |
| 4,099,371 | 7/1978 | Mochizuki | 58/38 R |
| 4,176,518 | 12/1979 | Kawakami et al. | 58/38 R |

*Primary Examiner*—J. V. Truhe
*Assistant Examiner*—William L. Feeney
*Attorney, Agent, or Firm*—Robert E. Burns; Emmanuel J. Lobato; Bruce L. Adams

[57] ABSTRACT

An electronic watch having a time counter circuit for developing a count representative of present time, a second time counter circuit for developing a count representative of time, and a chronograph counter circuit for developing a count representative of elapsed time. A predetermined time is stored in a memory circuit and the contents of the second time counter and the memory circuit are compared by a coincidence detecting circuit. When coincidence occurs a sound generating circuit is enabled for developing sound pulses to represent coincidence. A display visually displays time, and a display switching circuit switches between the present time counter, the memory circuit and the chronograph counter for applying the contents of a selected one thereof in order to visually display present time, the predetermined time and a time interval determined by the chronograph counter. A control circuit is effective for controlling the display switching circuit and operating the watch in different modes. The watch further includes an encoder for developing signals encoded in Morse code, and a sound signal generator for developing audio signals encoded in Morse code. A second switching circuit receives the output of the display switching circuit and, in response to control signals, applies the display switching circuit output to the encoder.

5 Claims, 3 Drawing Figures

9
9c
9d
9e
9f
9g
9h
9i
9j
9k
9l
9m
9n
9o
9p
9q
9r
9s
9t
9u
9v
46
47
48
49
50
51
52
53
54
45
44
43
3 BIT RING COUNTER
Q1 Q2 Q3
55
3 BIT RING COUNTER
Q1 Q2 Q3
56
57
58
59
60
61
TIME PULSE GEN. CIRCUIT
62
63
64
FF
65
66
7 BIT RING COUNTER
67
68
69
70
40a
40b
40
41
42
VDD
9a
9b 1
2
3
4
5
6
N.W.
T.A.
S.W.

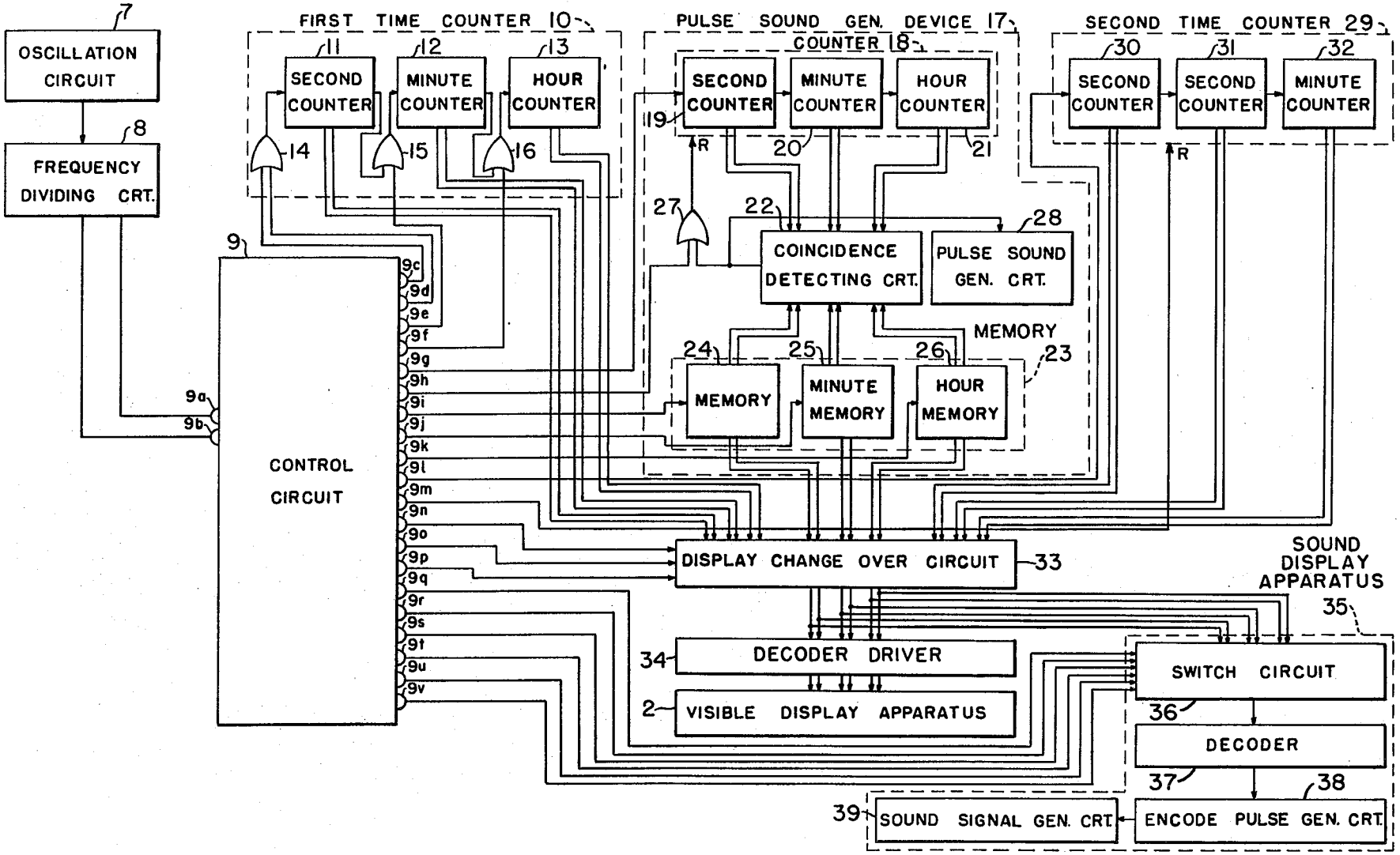
FIG. 2
OSCILLATION CIRCUIT
FREQUENCY DIVIDING CRT.
CONTROL CIRCUIT
FIRST TIME COUNTER 10
SECOND COUNTER
MINUTE COUNTER
HOUR COUNTER
PULSE SOUND GEN. DEVICE 17
SECOND COUNTER
MINUTE COUNTER
HOUR COUNTER
COINCIDENCE DETECTING CRT.
PULSE SOUND GEN. CRT.
MEMORY
MEMORY
MINUTE MEMORY
HOUR MEMORY
SECOND TIME COUNTER 29
SECOND COUNTER
SECOND COUNTER
MINUTE COUNTER
SOUND DISPLAY APPARATUS
DISPLAY CHANGE OVER CIRCUIT
SWITCH CIRCUIT
DECODER
ENCODE PULSE GEN. CRT.
DECODER DRIVER
VISIBLE DISPLAY APPARATUS
SOUND SIGNAL GEN. CRT.

ELECTRONIC WATCH

BACKGROUND OF THE INVENTION

The present invention relates to an electronic watch, and more particularly to an electronic watch designed for carrying out many functions. An electronic watch incorporating a function such as a stop watch has been proposed. However, such an electronic watch has had simply a function of a conventional stop watch. Accordingly for example, when it is desired to know the elapse of time during a time determination, or when a time period is determined, a visual indication element has had to be watched which is extremely inconvenient. And blind people cannot use the watch having only visible indicating elements for the ordinary time or the time period determination results. According to the using requirements of the electronic watch by normal people, the contents of a time counter such as time or the like may be preferably recognized by indicating them with sounds.

The present invention provides a new electronic watch adapted to satisfactorily execute functions as an electronic watch even under various conditions as mentioned before.

BRIEF DESCRIPTION OF DRAWINGS

FIG. 2 is a system view of the circuitry of the electronic watch and FIG. 3 shows an embodiment of the control circuitry of the electronic watch according to the present invention.

Figure 3:
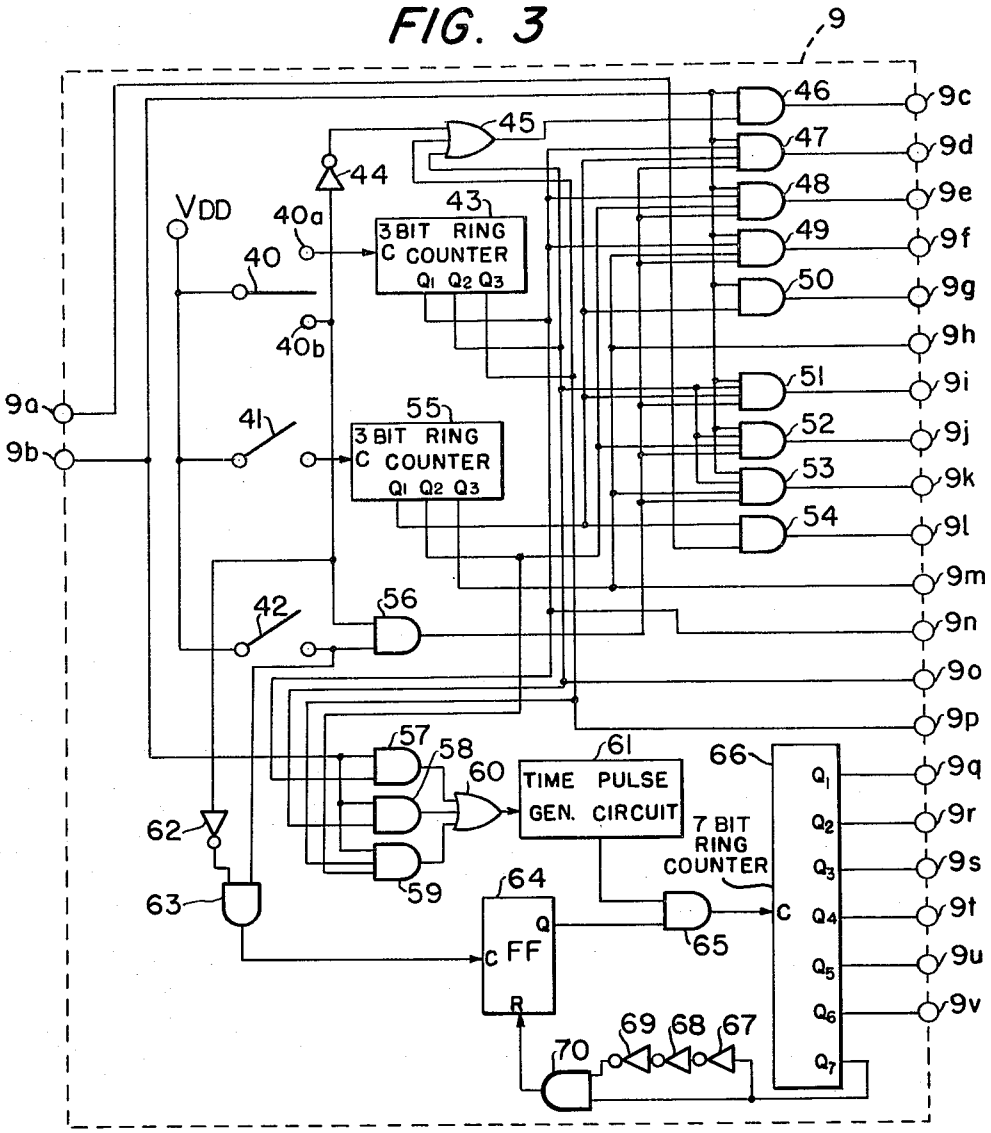

Referring to the drawing, the present invention will be explained in detail in conjunction with the illustrated embodiments.

DESCRIPTION OF THE PREFERRED EMBODIMENT

Figure 1:
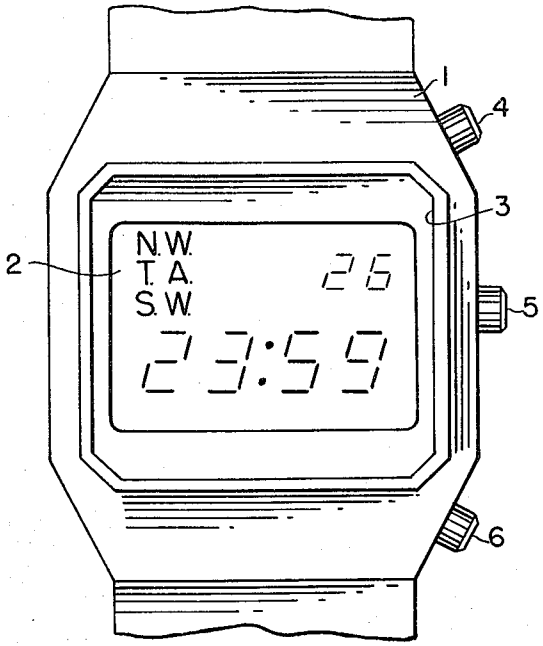
FIG. 1 shows an outline of the electronic watch according to the present invention.

FIG. 1 illustrates an embodiment of an electronic watch in accordance with the present invention, wherein reference numeral 1 is a case with the face side thereof illustrated. The case 1 is provided with a window portion through which a visual indicating device 2 is exposed for viewing. At a side surface of the case 1 end portions of the stems 4 5 and 6 are externally operably disposed.

FIG. 2 shows a block diagram illustrating a system of the electronic watch according to the present invention. Reference numeral 7 designates an oscillation circuit using a solid oscillator such as quartz-crystal oscillator. Oscillating output obtained from the oscillation circuit 7 is fed to a frequency dividing circuit 8 consisting of a plurality of frequency dividing stages. Reference numeral 9 is a control circuit and the detail thereof is described hereinbelow. The control circuit 9 has input terminals 9*a*, and 9*b* to which a frequency dividing circuit 8 output signals of 100 Hz and 1 Hz are transmitted and output terminals 9*c* to 9*v* feeding out control signals. From the output terminal 9*c*, a reference signal of 1 Hz is fed and transmitted to a first time counter 10 which counts and determines normal or present time. The first time counter 10 consists of a second counter 11 of 60 notation, a minute counter 12 of 60 notation, and a hour counter 13 of 24 notation and three OR circuits 14, 15 and 16. To the OR circuit 14, the 1 Hz reference signal mentioned above and a correcting pulse fed from the output terminal 9*d* of the control circuit 9 are transmitted and the output of the OR gate 14 is supplied to the second counter 11. A carry signal of the second counter 11 and a correcting pulse fed from the output terminal 9*e* of the control circuit 9 are applied to the OR circuit 15. An output of the OR circuit 15 is fed to the minute counter 12. A carry signal of the minute counter 12 and the correcting pulse fed to the OR circuit 16 out of the output terminal 9*f* are fed.

From output terminal 9*g*, a signal of 1 Hz is fed out and supplied to a counter 18 of a pulse sound generating device 17. The counter 18 is comprised of a second counter 19 of 60 notation a minute counter 20 of 60 notation, and a hour counter 21 of 24 notation. Counting output of the counter 18 is supplied to a coincidence detecting circuit 22.

The pulse sound generating device 17 has a memory 23 comprised of a memory 24, a minute memory 25, and a hour memory 26 to which are applied predetermined pulses of the respective output terminals 9*i*, 9*j*, 9*k* of the control circuit 9. Output of the memory 23 is fed to the coincidence detecting circuit 22. The coincidence detecting circuit 22 compares the contents of the counter 18 with those of the memory 23 and detects the coincidence therebetween. Output of the coincidence detecting circuit 22 is fed to a reset terminal R of the counter 18 through an OR circuit 27 to which is supplied a reset pulse fed out from the output terminal 9*h* of the control circuit 9 and also to a pulse sound generating circuit 28 generating pulse sounds of an audible range.

A signal of 100 Hz fed out from the output terminal 91 of the control circuit 9 is supplied to a second time counter 29 used as a stop watch. The second time counter 29 is composed of a 1/100 second counter 30 of 100 notation, a second counter 31 of 60 notation, and a minute counter 32 of 60 notation. To the reset terminal R is supplied a pulse fed out from the output terminal 9*m* of the control circuit 9.

A reference numeral 33 denotes a display change-over circuit to which the respective contents of the first and second time counters 10, 29 and memory 23 are applied and which responds to control signals transmitted from the output terminals 9*n*, 9*o* and 9*p* of the control circuit. Said display change-over circuit selects either one of the first, the second time counters 10, 29 and the memory 23 and supplies the contents of the selected counter or memory as an output thereof. The supplied contents are fed to a decoder driver 34 for driving driving the visual indicating device 2, and also to a switch circuit 36 of a sound display device 35. The switch circuit 36 responds to pulses fed out successively from the output terminals 9*q* to 9*v* of the control circuit 9. Then, the switch circuit changes over every digit and feeds out the respective counting contents of the supplied first and second time counters 10 and 29 and memory contents of the memory 23 are fed out. The output is converted into a decimal code by a decoder 37. A reference numeral 38 designates a encoded pulse generating circuit which responds to the output of the decoder 37 and feeds out an electric signal of Morse code corresponding to the contents applied to the switch circuit 36. The output of the encoded pulse generating circuit is converted into a Morse code sound signal by the second signal generating circuit 39.

FIG. 3 shows a circuit of an embodiment of the control circuit 9 represented by a rectangle in FIG. 2. The same reference numerals shown in FIG. 2 and FIG. 3 are applied to the same terminal.

In FIG. 3, the element 40 is a first switch which contacts a contact 40*a* by pushing the stem 5 shown in FIG. 1 and contacts a contact 40*b* by pulling out the stem 5. A reference numeral 41 shows a second switch which is turned ON by pushing the stem 4. A reference numeral 42 is a third switch which is turned ON by pushing the stem 6. A switch signal obtained at the contact 40*a* of the switch 40 is fed to a 3 bit ring counter 43. A switch signal obtained at the contact 40*b* is supplied to a three input OR circuit 45 through an inverter 44. An output of the OR circuit 45 is fed to a two input AND circuit 46 to which a signal of 1 Hz is transmitted from the input terminal 9*b*. An output of the AND circuit 46 is connected to the output terminal 9*c*.

An output from the output terminal Q1 of the ring counter 43 is fed to an input terminal of four input AND circuits 47, 48 and 49.

An output from the output terminal Q2 is supplied to an input terminal of the OR circuit 45, also to an input terminal of each of the AND circuits 51, 52 and 53, and further to an output terminal 90. An output of the output terminal Q3 is fed to a remaining input terminal of the OR circuit 45 and also to the output terminal 9*p*.

A switch signal obtained at the switch 41 is supplied to a three bit ring counter 55. An output of the output terminal Q1 of the ring counter 55 is fed to the AND circuits 47, 50, 51 and 54 respectively. An output of the output terminal Q2 is fed to the AND circuits 48 and 52 respectively. An output of the output terminal Q3 is supplied to the AND circuits 49 and 53 and also to the output terminals 9*h* and 9*m*.

A signal obtained in the switch 42 and a signal obtained at the contact 40*b* of the switch 40 are supplied to a two input AND circuit 56. An output of the AND circuit 56 is fed to the AND circuits 47, 48, 49, 51, 52 and 53.

To the AND circuits 47 to 53, a signal of 1 Hz as well as above-mentioned signals are supplied. Each output of the AND circuits 47 to 50 is fed to a respective one of the output terminals 9*d* to 9*g*. Each output of the AND circuits 51 to 53 is fed to a respective one of the output terminals 9*i* to 9*k*. To a remaining input terminal of the AND circuit 54, a signal of 100 Hz is supplied. An output thereof is transmitted to an output terminal 91.

A reference numeral 57 designates a two input AND circuit to which a signal of 1 Hz and an output of the output terminal Q1 of the ring counter 43 are fed. An output thereof is supplied to a three input OR circuit 60. A reference numeral 58 is a two input AND circuit to which a signal of 1 Hz and an output of the output terminal Q2 of the ring counter 43. An output thereof is supplied to an OR circuit 60. A reference numeral 59 is a three input AND circuit to which a signal of 1 Hz and an output of the output terminal Q2 of the ring counter 55 are fed. An output thereof is fed to the OR circuit 60.

An output of the OR circuit 60 is supplied to a time pulse generating circuit 61 producing a pulse at two second intervals. A signal obtained at the contact 40*b* of the switch 40 to the AND circuit 63 together with a signal obtained at the switch 42 which is fed to the AND circuit 63 through the inverter 62. An output thereof is supplied to a flip flop circuit 64 (called FF hereinafter). The Q output of the FF 64 and an output of the time pulse generating circuit 61 are supplied to a two input AND circuit 65. An output of the AND circuit 65 is transmitted to a clock terminal c of a 7 bit ring counter 66. Outputs obtained respectively from the output terminals Q1 to Q6 are fed to the output terminals 9*g* to 9*v*.

An output of the output terminal Q7 is supplied to an AND circuit 70 input terminal through inverters 67, 68 and 69 and also directly to the other input terminal of the AND circuit 70. An output thereof is supplied to a reset terminal R of the FF 64.

The operation of the electronic watch of the invention having the afore-mentioned construction will be explained hereinbelow.

At first, when a normal time is displayed, the switch 40 is actuated to feed a signal of a logic "1" from the output terminal Q1 of the ring counter 43. In this manner, from the output terminal 9*n* of the control circuit 9, a signal of a logic "1" is fed out. Responding to said signal, the display change-over circuit 33 selects the time counter 10 and feeds out the counting contents thereof. Similarly, when a signal of a logic "1" is fed out from the output terminal Q2 and Q3 of the ring counter 43, the display change-over circuit 33 changes over to feed out the contents of the memory 23 and those of the second time counter 29, respectively.

The respective fed out counting contents and memory contents fed out under control of the display change-over circuit 33 are displayed after being decoded by the decoder driver 34 by means of the visible display device 2. On the visible display device 2 shown in FIG. 1, letters N.W. T.A., and S.W. are indicated. The characters displayed in the visible display device 2 respectively show the functional condition of the electronic watch according to the present invention; and N.W. is displayed when the the contents of the first time counter 10 is to be displayed, T.A. is displayed when the contents of the memory 23 is to be displayed, and S.W. is displayed when the contents of the second time counter 29 is to be displayed.

Next, the operation of the pulse sound generating device 17 will be explained.

First of all, the switch 40 is operated in order to display the contents of the memory 23 in the visible display device 2. The stem 5 of the electronic watch is pulled out so as to make the switch 40 contact with the contact 40*b*. In order to generate pulse sounds every five second, for example, a switch 42 is operated to set the content of a second memory 24 in the memory 23 to "5" and to set the contents respectively of minute memory 25 and hour memory 26 to "0". After the setting operations, the switch 41 is operated once and a signal of logic level "1" is applied from an output terminal Q1 of the ring counter 55 in order to start a counting of the counter 18.

When the contents of the second counter 19 and the second memory 24 coincide with each other, a coincidence detection pulse is applied from the coincidence detection circuit 22 in order to reset the counter 18 as well as to generate a pulse sound from a pulse sound generating circuit 28.

The resepective operations will be repeated to generate pulse sounds every five seconds.

According to the present invention, the counter 18 and the memory 23 are able to be set at one-second steps for twenty four (24) hours, so that any pulse sound of a suitable time interval is obtained within twenty four hours. Accordingly, when the electronic watch is used to count a relatively short time, the wearer can know the time lapse by only hearing the pulse sound and it is not necessary to look at the display face of the electronic watch. The wearer can know correctly the time lapse without difficulty.

With a relative small reformation of the pulse sound generating circuit 28 of the electric watch, the watch is used as an usual alarm device.

In order to have the electronic watch function as a stop watch, the switch 40 is operated to display the content of the second time counter 29 in the visible display device 2. When the switch 41 is operated to develop an output of an output terminal Q1 at the ring counter 55, a counting operation of the second time counter 29 is started, and the counting operation is stopped by an output of the output terminal Q2.

Next, the second time counter 29 is reset by an output of the output terminal Q3.

Simultaneously with the counting operation explained above, a pulse sound generating device 17 operates. If the operation of the sound generating device 17 is not necessary, a switch (not shown) is provided, for example in the pulse sound generating circuit 28 and the switch is operated to terminate the operation of the sound generating device 17.

When the switch 42 is operated, signals of logic level "1" are sequentially applied from output terminals Q1 to Q7 of a ring counter 66 in the control circuit 9 to the switch circuit 36, and the contents of first time counter 10, memory 23 or second time counter 29 selected by the display change-over circuit 33 corresponding to the signals from output terminals Q1–Q7 are sequentially changed at each digit and passed through the switch circuit 36.

The output of the signals from the switch circuit 36 are supplied to an encode pulse generating circuit 38 through a decoder 37 so as to change them to decimal code. Electric Morse code signals are generated from the encode pulse generating circuit 38, which Morse code signals correspond to the contents sequentially changed-over and passed through the switch circuit 36. The electric Morse code signal is supplied to the sound signal generating circuit 39. In the sound signal generating circuit, the electric Morse code signal is changed to a sound signal of a predetermined frequency (audible zone).

Accordingly, when the first time counter 10 is selected by the display change-over circuit 33, operation of the switch 42 causes hearing of the time and simultaneously the time interval by pulse sound. Also, the contents of the second time counter can be known by sound. The contents of the second time counter 29 is changed at very high speed during time counting or measuring a time period, so that in order to sound-display only the time period upon stopping counting by the second time counter 29, AND circuits 57 to 59 and OR circuit 60 are provided in the control circuit 9.

As explained above, the time and the counting contents are displayed by encoded sound, and therefore the blind can advantageously enjoy the function of the electronic watch and simultaneously an ordinary man can effectively use the function of the watch in a dark place.

While the details of the electronic watch according to the present invention have be explained with reference to the preferred embodiment, the present invention is not limited to the particular embodiment shown and described, and it is my intention to cover hereby all novel adaptations, modifications, and arrangements thereof which come within the practice of those skilled in the art to which the invention relates. For example, by the output of the pulse sound generating apparatus 17, the sound display apparatus 35 can be operate to time-indicate by sound at every hour.

It is easy to display or indicate the difference between the counted or measured interval of the stop watch portion and the counted time counted by the electronic watch portion by using various encoded sounds.

As described above, the electronic watch of the present invention has a pulse sound generating apparatus for generating pulse sound at a fixed time interval, so that the wearer of the watch can know the time elapse only by hearing the pulse sound. Furthermore, the electronic watch can be used effectively to determine some frequency and also the blind as well as an ordinary person in the dark can determine the time by the use of the sound display apparatus indicating or displaying the time or the frequency by encoded sound. The encoding is not duration of the sound but by length thereof. Accordingly, there is no error on a musical interval or tone and the user of the electronic watch can effectively and practically determine the time etc.

What is claimed is:

1. An electronic watch comprising: an oscillator circuit for developing an oscillating output signal; a dividing circuit for dividing the oscillator output signal to develop a time standard signal; a present time counter circuit receptive of the time standard signal for developing a count representative of present time and responsive to a correction pulse for correcting the developed count; a pulse sound generator comprised of a second time counter circuit for developing a count representative of time, a memory circuit having contents representative of a predetermined time, a coincidence detecting circuit for developing a coincidence signal when the contents of said second time counter circuit and the contents of said memory circuit coincide, and a sound generating circuit for developing sound pulses in response to the coincidence signal; a chronograph counter responsive to control signals for operating in a chronograph mode; visual display means for visually displaying time; display switching circuit means for switching between said present time counter circuit, said memory circuit and said chronograph counter for applying the contents of the selected one thereof to said visual display means for visually displaying present time, the predetermined time and a time interval measured by said chronograph counter; and control circuit means operable for developing and applying selected ones of the above-mentioned control signals and the correction pulse for controlling operation of the electronic watch, wherein said control circuit means is effective for applying a control signal to said second time counter circuit to operate said second time counter circuit in a counting mode to continually count, and wherein said pulse sound generator includes resetting means for applying the coincidence signal from said coincidence detecting circuit to reset said second time counter circuit each time coincidence is detected between the contents of said second time counter circuit and said memory circuit whereby said sound generating circuit repetitively generates a sound each time the coincidence signal is developed after successive time intervals determined by the content of said memory circuit.

2. An electronic watch according to claim 1, further comprising: encoding means responsive to the output of said display switching circuit means for developing signals encoded in Morse code and representative of time; a sound signal generator responsive to the signals encoded in Morse code for developing audio signals encoded in Morse code; second switching circuit means connected to receive the output of said display switching circuit means and responsive to control signals for applying the output of said display switching circuit means to said encoding means; and wherein said control circuit means is effective for developing the control signals for controlling said second switching circuit means.

3. An electronic watch according to claim 1, wherein said display switching means is comprised of: a display change-over circuit responsive to control signals for applying the contents of the selected one of said present time counter circuit, said memory circuit and said chronograph counter to said visual display means; a ring counter within said control circuit means and having a plurality of output terminals for successively developing an output signal at successive ones of said output terminals in response to a clock signal successively applied to said ring counter; switching means within said control circuit means and comprising a manually operable switch for applying a clock signal to said ring counter in response to actuation of said manually operable switch; and means for applying the output signal from the respective output terminals of said ring counter as respective control signals to said display change-over circuit for selecting among said time counter circuit, said memory circuit and said chronograph counter.

4. An electronic watch according to claim 1, wherein said control circuit means includes a ring counter having a plurality of output terminals for successively developing an output signal at successive ones of said output terminals in response to a clock signal successively applied to said ring counter; switching means comprising a manually operable switch for applying a clock signal to said ring counter in response to actuation of said manually operable switch; means responsive to a first output signal for developing a control signal effective to enable said chronograph counter to count and for terminating the control signal to stop said chronograph counter from counting when the first output signal of said ring counter is terminated; and resetting means responsive to another output signal from said ring counter for resetting said chronograph counter.

5. An electronic watch according to claim 2, wherein said control circuit means includes a ring counter having a plurality of output terminals for successively developing an output signal at successive ones of said output terminals in response to a clock signal successively applied to said ring counter; resettable clock signal generating means for generating a sequence of clock signals and for applying the sequence of clock signals to said ring counter to enable said ring counter to generate the ring counter output signal at successive ones of said ring counter output terminals; resetting means responsive to the ring counter output signal developed at one of said ring counter output terminals for resetting said clock signal generating means to terminate the sequence of clock signals after the output signal of said counter has been successively developed at the plurality of ring counter output terminals; and means for applying the ring counter output signal developed at successive ones of said ring counter output terminals as control signals to said second switching circuit means; and wherein said second switching circuit means is effective to apply the output of said display switching circuit means to said encoding means digit-by-digit in response to the output signal of said ring counter successively developed at said ring counter output terminals.

* * * * *